US005103500A

United States Patent [19]

Nager et al.

[11] Patent Number: 5,103,500

[45] Date of Patent: Apr. 14, 1992

[54] ODOR SUPPRESSING DISPOSABLE GARMENT SHIELD

[76] Inventors: Frank B. Nager, 22411 Twyckingham, Southfield, Mich. 48034; Louis F. Heyman, 33000 Covington Club Dr., Apt. #42, Farmington Hills, Mich. 48018

[21] Appl. No.: 704,852

[22] Filed: May 20, 1991

Related U.S. Application Data

[63] Continuation of Ser. No. 506,673, Apr. 9, 1990, abandoned.

[51] Int. Cl.[5] ..... A41D 27/13

[52] U.S. Cl. ..... 2/56; 2/53; 604/359; 604/360; 604/387

[58] Field of Search ..... 2/53, 54, 55, 56; 604/359, 360, 366, 385.1, 370, 387

[56] References Cited

U.S. PATENT DOCUMENTS

| | | | |
|---|---|---|---|
| 279,195 | 6/1883 | Slocomb et al. | 424/65 |
| 3,412,033 | 11/1968 | Karsten et al. | 424/65 |
| 3,903,259 | 9/1975 | Hart | 424/76.3 X |
| 3,903,890 | 9/1975 | Mesek et al. | 604/365 |
| 3,928,605 | 12/1975 | Curry | 514/852 X |
| 3,940,482 | 2/1976 | Grand | 514/852 X |
| 3,943,243 | 3/1976 | Rook | 424/76.3 |
| 4,034,077 | 7/1977 | Hill et al. | 424/69 |
| 4,035,146 | 7/1977 | Brenner et al. | 424/494 X |
| 4,059,114 | 11/1977 | Richards | 604/366 X |
| 4,172,123 | 10/1979 | Lowicki | 424/67 |
| 4,385,632 | 5/1983 | Odelhög | 604/360 |
| 4,433,972 | 2/1984 | Malfitano | 604/385.1 |
| 4,463,045 | 7/1984 | Ahr et al. | 604/370 X |
| 4,471,871 | 9/1984 | Rockliffe et al. | 206/484 |
| 4,583,980 | 4/1986 | Schneider et al. | 604/359 |
| 4,589,876 | 5/1986 | Van Tilburg | 604/385.1 |
| 4,610,678 | 9/1986 | Weisman et al. | 604/368 |
| 4,631,752 | 12/1986 | Heyman et al. | 2/56 |
| 4,650,670 | 3/1987 | Callingham et al. | 424/65 |
| 4,687,478 | 8/1987 | Van Tilburg | 604/387 |
| 4,708,863 | 11/1987 | Bews et al. | 424/65 |
| 4,713,068 | 12/1987 | Wang et al. | 604/366 |
| 4,747,162 | 5/1988 | Yanagihara | 2/53 |
| 4,758,239 | 7/1988 | Yeo et al. | 604/366 |
| 4,828,556 | 5/1989 | Braun et al. | 604/366 X |
| 4,842,593 | 6/1989 | Jordan et al. | 604/360 |

FOREIGN PATENT DOCUMENTS

| | | | |
|---|---|---|---|
| 2617545 | 11/1977 | Fed. Rep. of Germany | 2/53 |
| 2822588 | 11/1979 | Fed. Rep. of Germany | 2/56 |
| 3339474 | 5/1985 | Fed. Rep. of Germany | 2/53 |
| 566705 | 2/1924 | France | 2/5 |
| 2496420 | 6/1982 | France | 2/53 |
| 0038951 | 3/1979 | Japan | 2/53 |
| 8500513 | 10/1985 | Netherlands | 2/53 |

*Primary Examiner*—Werner H. Schroeder
*Assistant Examiner*—Jeanette E. Chapman
*Attorney, Agent, or Firm*—Alex Rhodes

[57] ABSTRACT

A disposable garment shield for preventing garment soiling and combatting garment odors caused by perspiration comprising a laminated body having a layer of a non-absorbent polymer, an adhesive material on the non-absorbent layer for attaching the shield to a garment and a moisture absorbing layer of a fibrous material bonded to the non-absorbing polymeric layer, and a dry deodorant mixture which becomes activated by the perspiration of a wearer of a garment to absorb the perspiration and combat unpleasant body odors.

18 Claims, 1 Drawing Sheet

ODOR SUPPRESSING DISPOSABLE GARMENT SHIELD

This is a continuation of copending application Ser. No. 07/506,673 filed on Apr. 9, 1990, now abandoned.

BACKGROUND OF THE INVENTION

This invention relates to underarm garment shields and more particularly to a disposable garment shield for reducing unpleasant axillary odors and preventing garment soiling.

Garment shields prevent garment soiling by preventing perspiration from contacting garments. They are generally made from a laminated material consisting of an absorbent layer bonded to a non-absorbent layer and are attached to a garment with the absorbent layer facing outwardly and the non-absorbent layer adjacent to the garment. An example of a disposable shield is disclosed in Heyman et al. U.S. Pat. No. 4,631,752.

The unpleasant odors which are the product of body perspiration are believed to be caused by the bacterial decomposition of the apocrine sweat which exudes from the axillary regions. It is further believed that a deodorant must contain an anti-bacterial agent to be effective for combatting body odors. While current shields to a varying degree absorb perspiration, none are effective for combatting strong unpleasant body odors.

Heretofore, the unpleasant odors of apocrine sweat have been combatted by applying deodorants directly to the axillary regions with aerosol, roll-on or spray type applicators. The active ingredients of most of the deodorants have generally been fragrances and astringents, such as aluminum hydroxychloride, which mask the odors an inhibit the formation of sweat by the sweat glands.

There is concern that the application of deodorants directly to the skin may damage the skin because of the allergic reactions of some persons to astringent chemicals. There is also concern that chemical substances which interfere with natural body processes, such as astringents, are contrary to good health and should not be used. There is also concern about the use of aerosol dispensers because they contain freon propellants which adversely affect the ionosphere. With the current practice there is no control over the amount of deodorant which is applied by a user.

One alternative to the use of astringents is disclosed in Callingham et al. U.S. Pat. No. 4,650,670. Callingham advocates the application with aerosol, roll-on or spray type applicators of a highly moisture-absorbent polymer to absorb perspiration as soon as it is formed. Callingham contends that if perspiration is immediately absorbed, the same effects as astringents can be achieved. However, it will be appreciated that irritation may result from blocking the natural flow of perspiration by applying a polymer, however inert it may be, directly to the skin.

Another alternative to astringents is disclosed in Bews et al., U.S. Pat. No. 4,708,863. Bews advocates the application of zinc carbonate in a carrier liquid or gel medium. Bews contends that zinc carbonate suppresses axillary odors without blocking the flow of perspiration to an appreciable extent. Although this alternative may substitute for astringents, it is not effective for preventing garment soiling.

SUMMARY OF THE INVENTION

The present invention overcomes the foregoing problems and concerns by eliminating the direct application to the skin of a deodorant with an aerosol, roll-on or spray type applicator. Instead, a convenient, long lasting, easy to use disposable garment shield is provided which prevents garment soiling and combats body odors caused by perspiration. The improved shield has a laminated body comprised of a non-absorbent layer bonded to an absorbent layer of fibrous material. An adhesive material is bonded to the non-absorbent layer for attaching the shield to a garment.

The invention resides in dispersing throughout the moisture absorbing layer a dry deodorant mixture which becomes activated by the perspiration of a wearer of the garment. The dry deodorant mixture consists of a germicide, fragrance and a moisture absorbing polymer, either alone or in combination with each other to combat the unpleasant odors of the perspiration.

One benefit of the invention is that natural body processes are not inhibited, as is the case when deodorants are applied directly to the skin.

Another benefit, in addition to the foregoing benefit, is that the dry mixture is effective over a long time period since it is consumed only during contact with wet perspiration.

Another benefit, in addition to the foregoing benefits, is the elimination of the need to apply a deodorant.

Another benefit, in addition to the foregoing benefits, is an increase in the capacity of a garment shield to absorb perspiration.

Another benefit, in addition to the foregoing benefits, is the elimination of freon spray type deodorant applicators.

The foregoing features and benefits together with additional features and benefits will become more apparent by reference to the ensuing detailed description and accompanying drawing which disclose the invention in detail.

DETAILED DESCRIPTION OF THE PREFERRED EMBODIMENT

Figure 1:
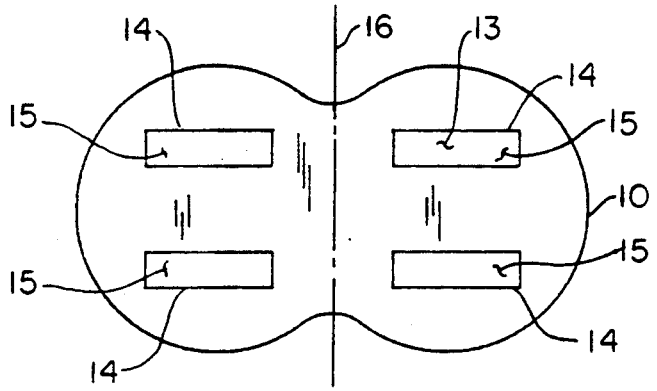
FIG. 1 is a plan view of a laminated disposable garment shield showing the fibrous moisture absorbing layer.
Figure 4:
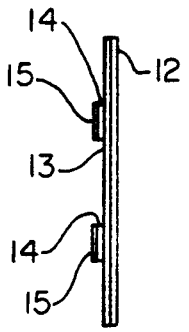
FIG. 4 is a cross-sectional view taken on the line 4—4 of FIG. 1.
Figure 2:
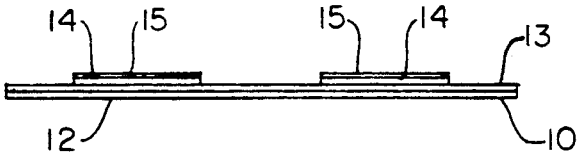
FIG. 2 is a front view of the disposable shield shown in FIG. 1.
Figure 3:
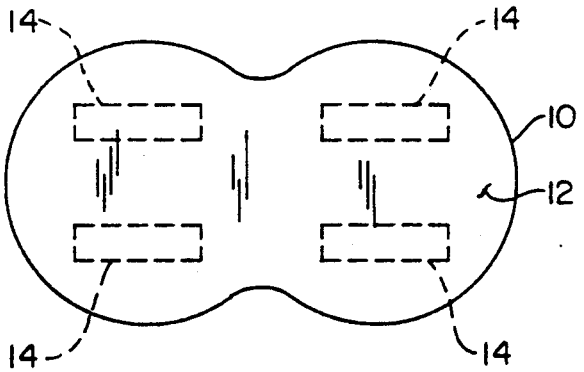
FIG. 3 is a bottom view of the shield showing the non-absorbing layer.

Referring now to the drawings wherein like numerals designate like and corresponding parts throughout the several views, a disposable shield is generally designated by the numeral 10 for illustrative purposes, and is not intended to limit the scope of our invention.

The disposable shield 10 has a generally circular body 11 and is comprised of a layer 12 of a highly absorbent fiber bonded to a layer 13 of a non-absorbent moisture repellant polymer.

Figure 5:
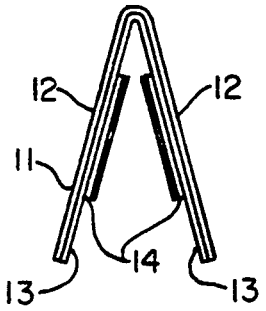
FIG. 5 is a view of the shield in a folded condition.

On the outer surface of the non-absorbent layer 13 there is a pair of adhesive strips 14 with peelable paper coverings 15. The shield 10 is applied to a garment by removing the peelable coverings 15 of the adhesive strips 14, folding the shield 10, as shown in FIG. 5, along a median line 16 such that the non-absorbing layer 13 faces inwardly, placing the shield 10 on the inside underarm portion of a garment, and securing the shield 10 with the adhesive strips 14. When the garment is worn, the fibrous absorbent layer 12 absorbs the perspiration of the wearer of the garment.

The absorbent layer 12 is impregnated with a mixture of a fragrance, germicide, a moisture-absorbent polymer and a solvent. The solvent is allowed to evaporate leaving a dry residue of the germicide, moisture-absorbing polymer and fragrance. When perspiration contacts the garment shield 10 the dry mixture is activated to combat the unpleasant odors from the perspiration.

The fragrance, which may or may not be present in the mixture, is any suitable fragrance which is commonly used in a conventional deodorant stick, aerosol spray and roll-on applicators.

The germicide is effective for combatting the bacteria found in the apocrine sweat which exudes from the axillary regions. It is non-irritating to the skin and is non-staining to garments. By way of example, one class of compounds which has been identified as filling these requirements is disclosed in U.S. Pat. No. 3,412,033, and includes active pyridinethione compounds selected from the group 1-hydroxy-2-pyridinethione, 2.2'-dithiopyridine-1, 1-di-oxide, and inorganic metal salts 1-hydroxy-2-pyridinethione in which the cation is selected from the group consisting of sodium, zinc, titanium, iron, manganese, zirconium, tin, cadmium and barium, in an amount of from about 10% by weight. Hexachlorophene, various quarternary ammonium compounds, triclorocarbanilide, triflouromethylcarbanilide, and tribromosalicylanilide are also exemplary of other germicides which can be used.

The moisture absorbing polymer is preferably capable of absorbing 5 to 10 times its own weight. Compounds which satisfy this requirement are disclosed in U.S. Pat. No. 4,650,670, incorporated herein by reference. They consist of certain non-cellulosic polysaccharides, polypeptides, vinyl carboxyl polymers and copolymers and their mixtures which have a high capacity for absorbing moisture. These polymers are capable of absorbing moisture in an amount at least 5 to 10 times their own weight. U.S. Pat. No. 279,195 identifies cornstarch as an effective deodorant material.

From the foregoing it will be appreciated that our disposable garment shield is convenient, easy to use and highly effective for combatting body odors and preventing garment soiling. Moreover, these advantages are obtained without the necessity of interfering with the natural secretion of sweat or of applying chemical substances directly to the skin.

Although a single embodiment has been described, it will be understood that other embodiments can be developed by mere changes in shape, materials and arrangement of parts without departing from the spirit thereof. Moreover, the moisture absorbing layer of a disposable shield may be impregnated with a mixture of the germicide and the moisture absorbing polymer or either one without the other.

We claim:

1. A disposable garment shield for preventing garment soiling and combatting garment odors caused by the bacterial decomposition of apocrine perspiration which exudes from the axillary regions of a wearer of a garment comprising: a laminated body having a single layer of a non-absorbent polymer and a single moisture absorbing layer of a fibrous material bonded to the non-absorbing polymeric layer, said body being adapted to be adhesively applied to a garment for absorbing perspiration which exudes from the axillary regions of a wearer of said garment; and a dry deodorant material dispersed throughout the fibrous moisture absorbing layer, said deodorant material being activated by said perspiration of said wearer of said garment to combat said unpleasant odors of said perspiration.

2. The disposable garment shield recited in claim 1 wherein said laminated body is a circular shaped body.

3. The disposable garment shield recited in claim 1 wherein said dry deodorant material which becomes activated by the perspiration of a wearer of a garment is a germicide.

4. The disposable garment shield recited in claim 1 wherein said dry deodorant material which becomes activated by the perspiration of a wearer of a garment is a moisture absorbing material.

5. The disposable garment shield recited in claim 1 wherein said dry deodorant material which becomes activated by the perspiration of a wearer of a garment is a fragrance.

6. The disposable garment shield recited in claim 1 further comprising an adhesive means on the surface of said non-absorbing layer for attaching the shield to a garment.

7. The disposable garment shield recited in claim 3 wherein said germicide is a pyridinethione compound.

8. The disposable garment shield recited in claim 3 wherein said germicide is hexachlorophene.

9. The disposable garment shield recited in claim 3 wherein said germicide is a quarternary ammonium compound.

10. The disposable garment shield recited in claim 3 wherein said germicide is triclorocarbanilide.

11. The disposable garment shield recited in claim 3 wherein said germicide is tribromosalicylanilide.

12. The disposable garment shield recited in claim 4 wherein said moisture absorbing material is corn-starch.

13. The disposable garment shield recited in claim 4 wherein said moisture absorbing material is a moisture absorbing polymer capable of absorbing moisture in an amount at least 5 to 10 times its own weight.

14. The disposable garment shield recited in claim 13 wherein said moisture absorbing polymer contains a non-cellulosic polysaccharide.

15. The disposable garment shield recited in claim 13 wherein said moisture absorbing polymer contains a non-cellulosic polypeptide.

16. The disposable garment shield recited in claim 13 wherein said moisture absorbing polymer contains a non-cellulosic vinyl carboxyl polymer.

17. A disposable garment shield for preventing garment soiling and combatting garment odors caused by the bacterial decomposition of apocrine perspiration which exudes from the axillary regions of a wearer of a garment comprising: a laminated body having a single layer of a non-absorbent polymer and a single moisture absorbing layer of a fibrous material bonded to the non-absorbing polymeric layer, said body being adapted to be adhesively applied to a garment for absorbing perspiration which exudes from the axillary regions of a wearer of said garment; and a dry deodorant mixture of a germicide and a moisture absorbing polymer dispersed throughout said fibrous moisture absorbing layer, said dry germicide and said dry moisture absorbing polymer being activated by the perspiration of said wearer of said garment having said shield and co-acting with each other to absorb said perspiration and combat said unpleasant odors of said perspiration.

18. A disposable garment shield for preventing garment soiling and combatting garment odors caused by the bacterial decomposition of apocrine perspiration which exudes from the axillary regions of a wearer of a garment comprising: a laminated body having a single layer of a non-absorbent polymer and a single moisture absorbing layer of a fibrous material bonded to the non-absorbing polymeric layer, said body being adapted to be adhesively applied to a garment for absorbing perspiration which exudes from the axillary regions of a wearer of said garment; and a dry deodorant mixture of a germicide, a moisture absorbing polymer and a fragrance dispersed throughout said fibrous moisture absorbing layer, said dry germicide, dry moisture absorbing polymer and dry fragrance being activated by the perspiration of said wearer of said garment having said shield to absorb said perspiration and combat said unpleasant odors of said perspiration.

* * * * *